US010242817B2

(12) United States Patent
Ohara

(10) Patent No.: US 10,242,817 B2
(45) Date of Patent: Mar. 26, 2019

(54) SWITCH HOUSING PROTRUSION SECURES BOARD WITH FIXED CONTACT

(71) Applicant: ALPS ELECTRIC CO., LTD., Tokyo (JP)

(72) Inventor: Hiroshi Ohara, Miyagi (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/941,103

(22) Filed: Mar. 30, 2018

(65) Prior Publication Data

US 2018/0301297 A1 Oct. 18, 2018

(30) Foreign Application Priority Data

Apr. 13, 2017 (JP) ..... 2017-079417

(51) Int. Cl.

| | |
|---|---|
| ***H01H 13/10*** | (2006.01) |
| ***H01H 13/48*** | (2006.01) |
| ***H01H 13/52*** | (2006.01) |
| ***H01H 13/06*** | (2006.01) |
| *H01H 9/04* | (2006.01) |

(52) U.S. Cl.

CPC ..... *H01H 13/10* (2013.01); *H01H 13/06* (2013.01); *H01H 13/48* (2013.01); *H01H 13/52* (2013.01); *H01H 9/04* (2013.01); *H01H 2203/026* (2013.01); *H01H 2205/004* (2013.01); *H01H 2215/006* (2013.01); *H01H 2215/03* (2013.01); *H01H 2221/05* (2013.01); *H01H 2223/002* (2013.01); *H01H 2229/034* (2013.01); *H01H 2229/05* (2013.01)

(58) Field of Classification Search

CPC ..... H01H 13/10; H01H 13/48; H01H 13/52; H01H 2203/026; H01H 2205/00; H01H 2205/002; H01H 2205/004; H01H 2205/032; H01H 2215/034; H01H 2215/036; H01H 2221/05; H01H 2229/034

See application file for complete search history.

(56) References Cited

U.S. PATENT DOCUMENTS

| | | | | |
|---|---|---|---|---|
| 6,392,174 | B1 | 5/2002 | Gotoh | |
| 6,794,589 | B2 * | 9/2004 | Kubat | H01H 25/008 200/4 |
| 6,809,274 | B2 * | 10/2004 | Takeuchi | H01H 25/06 200/4 |
| 6,946,610 | B2 * | 9/2005 | Takeuchi | H01H 13/20 200/302.2 |
| 2002/0079200 | A1 * | 6/2002 | Juret | H01H 25/06 200/4 |

FOREIGN PATENT DOCUMENTS

| | | |
|---|---|---|
| JP | 2003-257282 | 9/2003 |
| JP | 2014-071995 | 4/2014 |

* cited by examiner

*Primary Examiner* — Vanessa Girardi
(74) *Attorney, Agent, or Firm* — IPUSA, PLLC

(57) ABSTRACT

A switch includes a housing including a bottom surface and a protrusion formed on the bottom surface, a board that is placed on the bottom surface of the housing and includes a fixed contact, the board and the protrusion being fitted together, a movable contact that is disposed to cover at least portions of the fixed contact and the protrusion and configured to be inverted, and an operation part that presses the movable contact toward the fixed contact.

7 Claims, 6 Drawing Sheets

SWITCH HOUSING PROTRUSION SECURES BOARD WITH FIXED CONTACT

CROSS-REFERENCE TO RELATED APPLICATION

The present application is based upon and claims the benefit of priority of Japanese Patent Application No. 2017-079417, filed on Apr. 13, 2017, the entire contents of which are incorporated herein by reference.

BACKGROUND OF THE INVENTION

1. Field of the Invention

An aspect of this disclosure relates to a switch.

2. Description of the Related Art

A tactile switch includes a fixed contact provided on a board and a movable contact disposed above the movable contact. Tactile switches have come to be used for various purposes, and there is a demand for smaller tactile switches.

In related-art tactile switches, bosses for fixing a board to a housing are disposed on the outer side of a movable contact (see, for example, Japanese Laid-Open Patent Publication No. 2014-071995). With this configuration, the maximum size of the movable contact is limited by the bosses. When the size of a tactile switch is reduced, the size of the movable contact, which is already limited by the bosses, is further reduced, and as a result, the life of the tactile switch is reduced.

SUMMARY OF THE INVENTION

In an aspect of this disclosure, there is provided a switch that includes a housing including a bottom surface and a protrusion formed on the bottom surface, a board that is placed on the bottom surface of the housing and includes a fixed contact, the board and the protrusion being fitted together, a movable contact that is disposed to cover at least portions of the fixed contact and the protrusion and configured to be inverted, and an operation part that presses the movable contact toward the fixed contact.

DESCRIPTION OF THE PREFERRED EMBODIMENTS

Embodiments of the present invention are described below with reference to the accompanying drawings.

Throughout the specification and the drawings, the same reference number is assigned to components having substantially the same function and configuration, and repeated description of those components is omitted.

Figure 1:
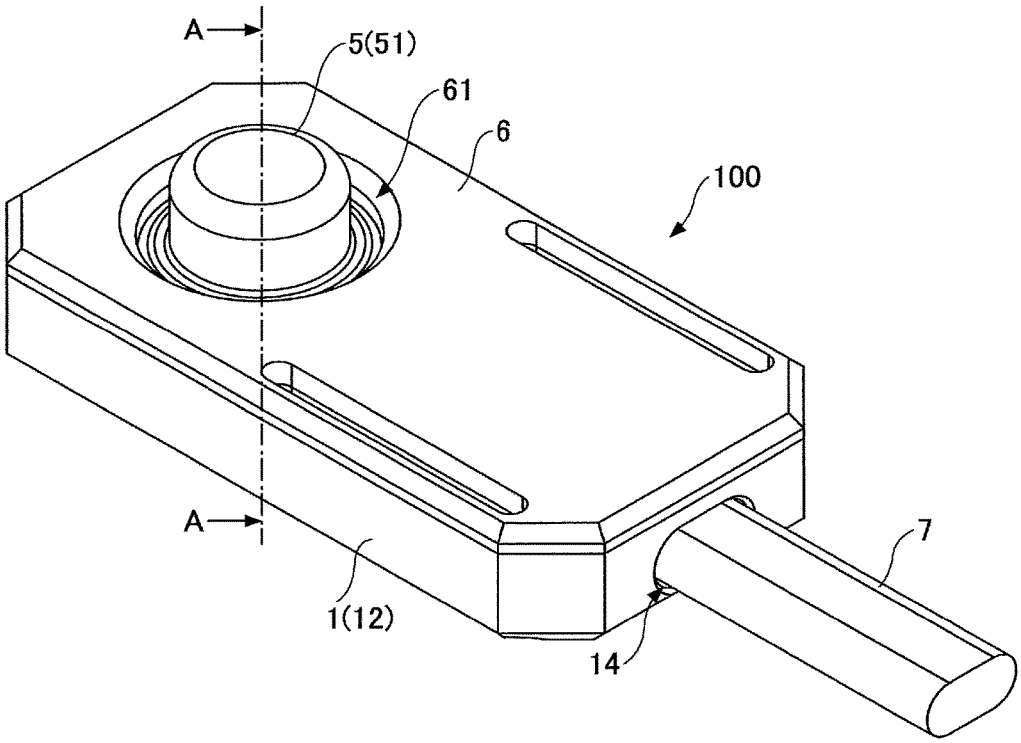
FIG. 1 is a perspective view of a switch.
Figure 2:
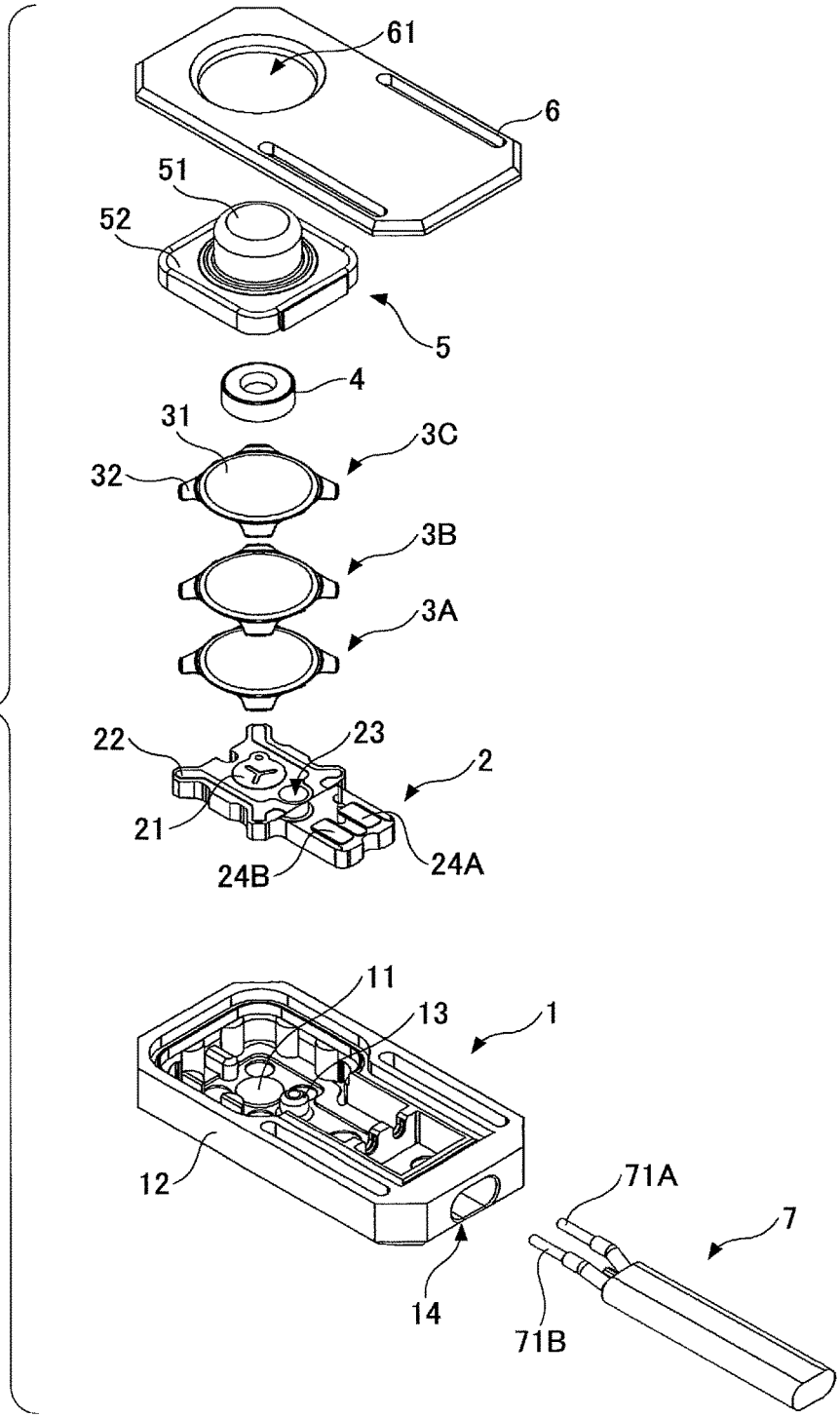
FIG. 2 is an exploded perspective view of a switch.

A switch 100 according to an embodiment is described with reference to FIGS. 1 through 7. The switch 100 is an example of a tactile switch. FIG. 1 is a perspective view of the switch 100. FIG. 2 is an exploded perspective view of the switch 100. As illustrated in FIGS. 1 and 2, the switch 100 includes a housing 1, a board 2, movable contacts 3A through 3C, a stem 4, an operation part 5, and a lid 6.

The housing 1 is made of a resin and constitutes the outer wall of the switch 100 together with the operation part 5 and the lid 6. As illustrated in FIG. 2, the housing 1 houses the board 2, the movable contacts 3A through 3C, the stem 4, and the operation part 5. The housing 1 includes a bottom surface 11 and a side wall 12.

A boss 13 is provided on the bottom surface 11. The boss 13 is a protrusion protruding upward from the bottom surface 11 and is fitted into an opening 23 of the board 2 to fix the board 2. The boss 13 is described in more detail below. In the example of FIG. 2, the bottom surface 11 has a substantially-rectangular shape. However, the shape of the bottom surface 11 is not limited to a rectangular shape.

The side wall 12 extends upward from the outer edge of the bottom surface 11. In the example of FIG. 2, the side wall 12 includes an opening 14 through which a wire harness 7 is connected to the board 2 placed in the housing 1. Alternatively, the opening 14 may be formed in the bottom surface 11.

The board 2 is placed on the bottom surface 11 of the housing 1. The board 2 includes a first contact 21, a second contact 22, an opening 23, and output terminals 24A and 24B.

The first contact 21 and the second contact 22 are fixed contacts formed on a surface of the board 2, and are implemented by, for example, a conductive material printed on the surface of the board 2 or a copper foil pasted on the surface of the board 2. The switch 100 is turned on when the first contact 21 and the second contact 22 are electrically connected to each other, and is turned off when the first contact 21 and the second contact 22 are electrically disconnected from each other. Because the first contact 21 and the second contact 22 are not electrically connected to each other in a normal state (where the operation part 5 is not being pressed), the switch 100 is off in the normal state.

The opening 23 is a through hole, and the boss 13 formed on the bottom surface 11 of the housing 1 is fitted into the opening 23.

The output terminal 24A is electrically-connected to the first contact 21 and is also connected to a terminal 71A of the wire harness 7. The output terminal 24B is electrically-connected to the second contact 22 and is also connected to a terminal 71B of the wire harness 7.

The movable contacts 3A through 3C are metal disc springs (metal contacts) and are stacked on the board 2. More specifically, the movable contact 3A is placed on the board 2. The movable contact 3B is placed on the movable contact 3A. The movable contact 3C is placed on the movable contact 3B. Hereafter, the movable contacts 3A through 3C may be collectively referred to as a "movable contact 3" when it is not necessary to distinguish them. The movable contact 3 includes a contact 31 and legs 32.

The contact 31 has an upward-convex shape and is configured to contact the first contact 21 when the operation part 5 is pressed. The contact 31 is inverted when the operation part 5 is pressed, and the inversion of the contact 31 generates a click feel. Here, the inversion of the contact 31 indicates that the contact 31 changes from the upward-convex shape into a downward-convex shape when the operation part 5 is pressed. In the example of FIG. 2, the contact 31 has a circular shape. However, the shape of the contact 31 is not limited to a circular shape.

Multiple legs 32 are provided along the outer circumference of the contact 31. The legs 32 support the contact 31 in a position above the board 2 (the first contact 21). The legs 32 are in contact with the second contact 22 and electrically connect the second contact 22 to the contact 31. In the example of FIG. 2, four legs 32 are provided around the contact 31. However, the number of the legs 32 is not limited to four and may be three, five, or more.

The movable contact 3 may instead be formed of a resin such as silicon rubber. In this case, a contact 31 formed of a conductive material such as a metal or carbon may be provided in a part (which contacts the first contact 21) of the lower surface of the movable contact 3. Also in this case, fixed contacts (the first contact 21 and the second contact 22) may be arranged such that the contact 31 can be brought into contact with and moved away from the fixed contacts.

Also in the example of FIG. 2, the switch 100 includes three movable contacts 3. However, the number of the movable contacts 3 is not limited to three and may be one, two, four, or more. The number of the movable contacts 3 may be determined based on a click feel desired for the switch 100.

Also in the example of FIG. 2, the movable contact 3 has a cross shape where four legs 32 are formed along the outer circumference of the contact 31. However, the shape of the movable contact 3 may be a circular shape instead of a cross shape. In this case, the outer edge of the circular contact 31 functions as the legs 32.

The stem 4 is placed on the contact 31 of the movable contact 3. When an operator presses the operation part 5 downward, the movable contact 3 is pressed downward via the stem 4 and contacts the first contact 21. As a result, the first contact 21 and the second contact 22 are electrically connected to each other via the movable contact 3, and the switch 100 is turned on. Also, the stem 4 is preferably disposed such that the center of the stem 4 matches the center of the contact 31. This configuration enables the operator to more reliably press the center of the movable contact 3 and obtain a better operation feel. When the operation part 5 is configured to directly press the movable contact 3, the stem 4 may be omitted.

The operation part 5 is formed of a resin such as silicon rubber and is placed on the stem 4 to cover a space above the movable contact 3 placed on the board 2.

The operation part 5 includes an operating part 51 and a cover 52. The operating part 51 protrudes upward and is operated (pressed) by the operator of the switch 100. In the example of FIG. 2, one operating part 51 is provided for one cover 52. However, multiple operating parts 51 may be provided for one cover 52. In this case, the first contact 21, the second contact 22, the movable contact 3, and the stem 4 are provided for each of the operating parts 51.

The cover 52 supports the operating part 51 in a predetermined position relative to the housing 1, and is disposed such that the outer surface of the cover 52 contacts the side wall 12 of the housing 1. With this configuration, a space above the board 2 on which the movable contact 3 is placed is hermetically closed by the operation part 5. This in turn prevents entry of water and foreign matter into the space above the board 2 on which the movable contact 3 is placed, and makes it possible to increase the life of the switch 100.

The lid 6 is made of a resin and covers the housing 1. The lid 6 is disposed above the operation part 5, and the outer edge of the lid 6 is attached to an upper part of the side wall 12 of the housing 1. The lid 6 includes an opening 61.

The opening 61 is a through hole having a diameter greater than the outside diameter of the operating part 51 of the operation part 5, and the operating part 51 protrudes upward through the opening 61. The lid 6 is fixed to the housing 1 in a state where the operating part 51 is protruding through the opening 61. When the lid 6 is fixed to the housing 1, the cover 52 of the operation part 5 is pressed between the lid 6 and the housing 1. This configuration further prevents entry of water and foreign matter into the space above the board 2 on which the movable contact 3 is placed, and makes it possible to increase the life of the switch 100.

Figure 3:
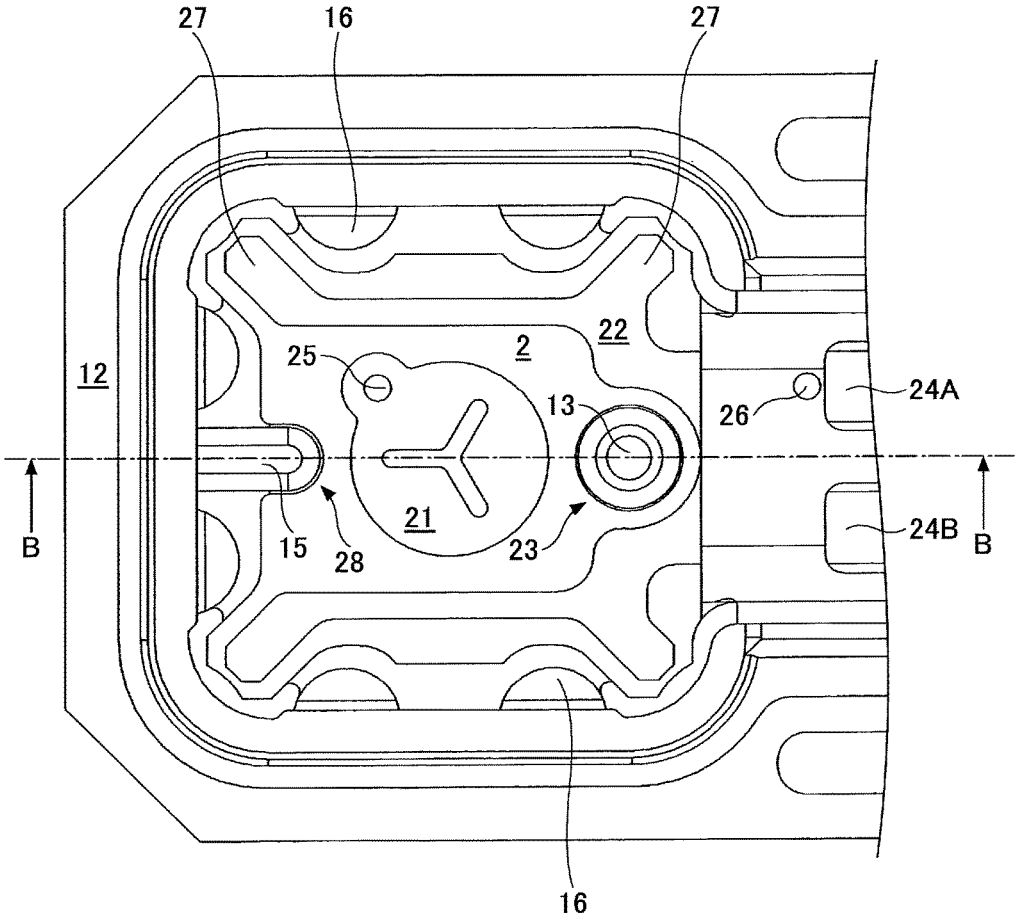
FIG. 3 is a plan view of a portion of a board including fixed contacts.
Figure 4:
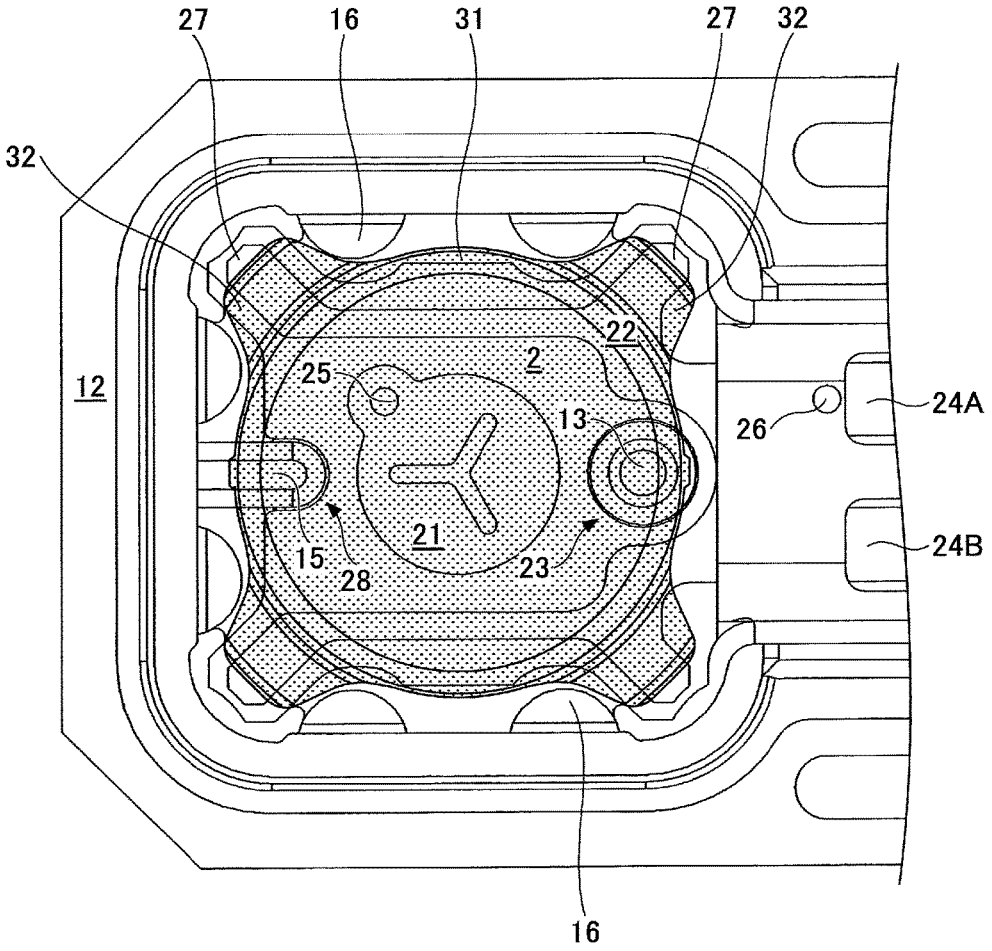
FIG. 4 is a plan view of a portion of a board including fixed contacts.

FIGS. 3 and 4 are plan views of a portion of the board 2 including the fixed contacts (the first contact 21 and the second contact 22). In FIG. 3, the movable contact 3, the stem 4, the operation part 5, and the lid 6 are omitted. In FIG. 4, the stem 4, the operation part 5, and the lid 6 are omitted, and the movable contact 3 is illustrated as a transmissive image.

As illustrated in FIG. 3, the first contact 21 is disposed in the middle of the board 2. The operating part 51 is disposed above the first contact 21 so that the operating part 51 can press the contact 31 of the movable contact 3 toward the first contact 21.

A through electrode 25 passes through the board 2 to its lower surface and is electrically connected to the first contact 21. Also, a through electrode 26 passes through the board 2 to its lower surface and is electrically connected to the output terminal 24A. The through electrodes 25 and 26 are electrically connected to each other on the lower surface of the board 2. Accordingly, the first contact 21 and the output terminal 24A are electrically connected to each other. In the example of FIG. 3, the first contact 21 has a substantially circular shape. However, the shape of the first contact 21 is not limited to a circular shape.

The second contact 22 is formed on the periphery of the board 2 to surround at least a part of the first contact 21. In the example of FIG. 3, the second contact 22 is formed to surround three sides of the first contact 21. However, the second contact 22 may be formed to surround four sides of the first contact 21. The second contact 22 is connected to the output terminal 24B on the upper surface of the board 2.

The second contact 22 includes multiple contacts 27. The contacts 27 extend toward the outer edge of the board 2 and are in contact with the legs 32 of the movable contact 3. In the example of FIG. 3, four contacts 27 are provided to correspond to four legs 32. As illustrated in FIG. 3, the contacts 27 preferably extend to positions near the outer edge of the board 2. This configuration makes it possible to increase the size of the movable contact 3 that is placeable on the board 2. As illustrated in FIG. 4, the movable contact 3 is disposed such that the legs 32 contact the corresponding contacts 27.

Also, a first guide 15 and second guides 16 are provided on the side wall 12 of the housing 1.

The first guide 15 is used to position the board 2 on the bottom surface 11, and extends inward from the side wall 12 of the housing 1. Also, a recess 28, which engages with the first guide 15, is formed in the outer edge of the board 2. When placing the board 2 on the bottom surface 11, the recess 28 and the first guide 15 are fitted together so that the board 2 is placed in a predetermined position on the bottom surface 11.

The height of the first guide 15 is preferably lower than the height of the board 2 so that the moving range of the movable contact 3 is not limited, i.e., so that the movable contact 3 does not touch the first guide 15 when the movable contact 3 is pressed. Although one first guide 15 is provided in the example of FIG. 3, multiple first guides 15 may instead be provided.

The second guides 16 are used to position the movable contact 3 on the board 2, and protrude inward from the side wall 12 of the housing 1. More specifically, as illustrated in FIG. 4, the second guides 16 are formed to touch portions of the outer edge of the movable contact 3 when the movable contact 3 is placed on the board 2. That is, when the movable contact 3 is placed on the board 2, the second guides 16 touch the portions of the outer edge of the movable contact 3 and thereby place the movable contact 3 in a predetermined position where the legs 32 of the movable contact 3 touch the contacts 27 of the second contact 22 on the board 2.

The height of the second guides 16 is preferably higher than the height of the contact 31 of the movable contact 3 placed on the board 2 so that the second guides 16 can touch the portions of the outer edge of the movable contact 3. Although six second guides 16 are provided in the example of FIG. 4, the number of the second guides 16 is not limited to six. The board 2 is preferably formed in such a shape that the board 2 does not touch the second guides 16 when the board 2 is placed on the bottom surface 11. This configuration makes it possible to reduce the dimensional accuracy required for the shape of the board 2.

As described above, the board 2 is placed on the bottom surface 11 with the boss 13 fitted into the opening 23. As illustrated in FIG. 4, the opening 23 and the boss 13 are disposed such that at least portions of the opening 23 and the boss 13 are positioned below the movable contact 3 when the board 2 is placed on the bottom surface 11. In other words, the movable contact 3 is disposed to cover at least portions of the opening 23 and the boss 13. This configuration prevents the boss 13 from limiting the size of the movable contact 3 and thereby makes it possible to increase the size of the movable contact 3 that is placeable on the board 2.

The opening 23 and the boss 13 are disposed between two legs 32 (or two contacts 27). Compared with a configuration where the opening 23 and the boss 13 are disposed in the middle of multiple legs 32 (or contacts 27), the configuration of the present embodiment makes it possible to increase the size of the first contact 21. This in turn enables the first contact 21 and the contact 31 to contact each other more reliably. Also, compared with a configuration where the opening 23 and the boss 13 are disposed around the legs 32 (or the contacts 27), the configuration of the present embodiment makes it possible to increase the sizes of the opening 23 and the boss 13. This in turn makes it possible to improve the strength of the boss 13 and improve the accuracy in positioning the board 2.

The height of the boss 13 is preferably lower than the height of the board 2 so that the moving range of the movable contact 3 is not limited, i.e., so that the movable contact 3 does not touch the boss 13 when the movable contact 3 is pressed. Although one boss 13 is provided in the example of FIG. 4, multiple bosses 13 may instead be provided.

Figure 5:
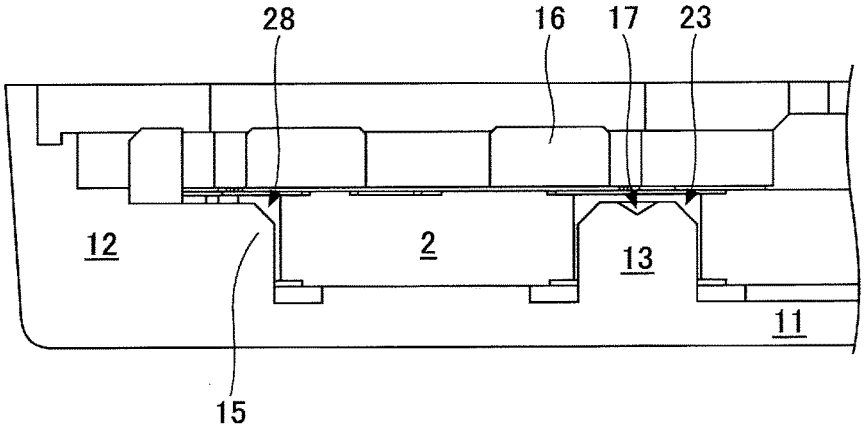
FIG. 5 is a cross-sectional view taken along line B-B of FIG. 3 and illustrating a state before a board is fixed to a housing.
Figure 6:
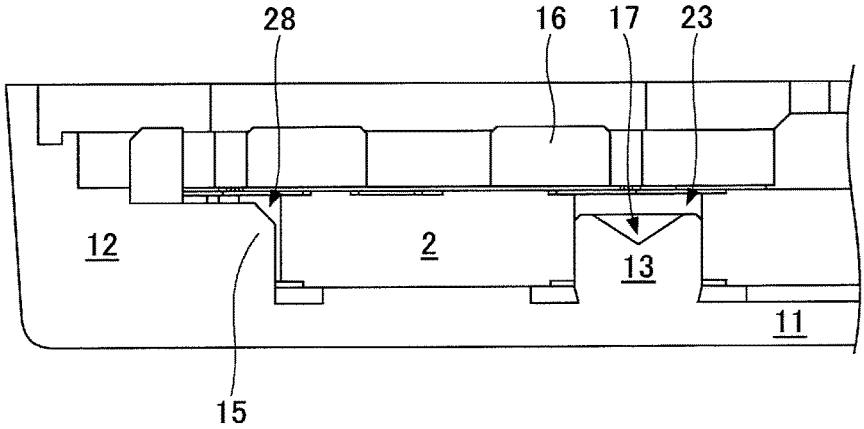
FIG. 6 is a cross-sectional view taken along line B-B of FIG. 3 and illustrating a state after a board is fixed to a housing.
Figure 7:
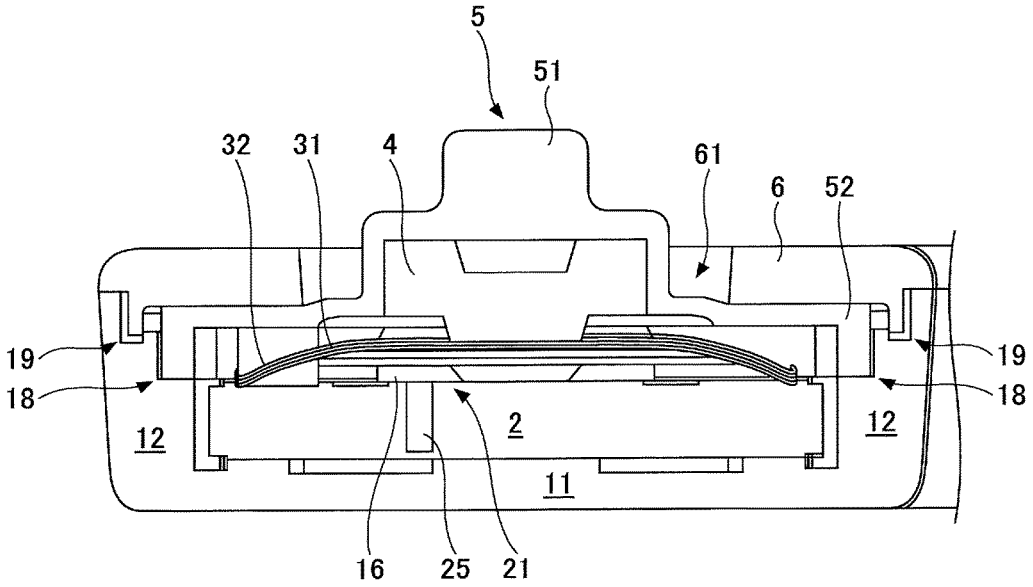
FIG. 7 is a cross-sectional view taken along line A-A of FIG. 1.

Next, a method of assembling the switch 100 of the present embodiment is described. In the descriptions below, it is assumed that a worker assembles the switch 100. However, the switch 100 can be automatically assembled by a machine according to substantially the same method. FIG. 5 is a cross-sectional view taken along line B-B of FIG. 3 and illustrating a state before the board 2 is fixed to the housing 1. FIG. 6 is a cross-sectional view taken along line B-B of FIG. 3 and illustrating a state after the board 2 is fixed to the housing 1. FIG. 7 is a cross-sectional view taken along line A-A of FIG. 1.

As illustrated in FIG. 5, the board 2 is placed on the bottom surface 11 by fitting the first guide 15 and the recess 28 together and fitting the boss 13 into the opening 23. As a result, the board 2 is placed in a predetermined position on the bottom surface 11. As illustrated in FIG. 5, the diameter of the boss 13 is less than the diameter of the opening 23 so that the boss 13 can be fitted into the opening 23. Also, in the example of FIG. 5, the heights of the first guide 15 and the boss 13 are lower than the height of the board 2 so that the moving range of the movable contact 3 is not limited by the first guide 15 and the boss 13.

After the board 2 is placed on the bottom surface 11, the upper end of the boss 13 is beaten out (flattened or spread out) using a punch. Although not illustrated, the punch preferably includes a conical protrusion that protrudes downward. A recess 17 for inserting the tip of the protrusion of the punch is preferably formed in the center of the upper end of the boss 13. With the tip of the protrusion of the punch inserted in the recess 17, the punch is pressed down to beat out (flatten or spread out) the boss 13. As a result, as illustrated in FIG. 6, the diameter of the boss 13 increases evenly and the boss 13 becomes immovable in the opening 23. Thus, the board 2 is fixed to the housing 1.

Next, the movable contact 3 is placed on the board 2 such that the legs 32 of the movable contact 3 touch the contacts 27 of the second contact 22 and portions of the outer edge of the movable contact 3 touch the second guides 16. As a result, as illustrated in FIG. 4, the movable contact 3 is placed in a predetermined position on the board 2. When the movable contact 3 is placed on the board 2, the contact 31 is supported by the legs 32 in a position above the first contact 21 as illustrated in FIG. 7.

Next, with the stem 4 fitted in a recess formed in the lower surface of the operating part 51, the operation part 5 is attached to the side wall 12. As a result, the stem 4 is placed on the contact 31 of the movable contact 3, and the operation part 5 is placed on the stem 4. The lower surface of the stem 4 touches the upper surface of the contact 31, and the upper surface of the stem 4 touches the lower surface of the operating part 51. With this configuration, the contact 31 can be pressed toward the first contact 21 by pressing the operating part 51. As illustrated in FIG. 7, the side wall 12 preferably includes an engaging part 18 that engages with the outer edge of the operation part 5 (the cover 52). The outer edge of the operation part 5 may be bonded with an adhesive to the side wall 12.

Then, with the operating part 51 protruding through the opening 61, the lid 6 is attached to the side wall 12 of the housing 1. As illustrated in FIG. 7, the side wall 12 preferably includes an engaging part 19 that engages with the lid 6. The lid 6 may be bonded with an adhesive to the side wall 12. Through the above process, the switch 100 is assembled.

As described above, according to the present embodiment, the size of the movable contact 3 is not limited by the boss 13. Thus, compared with the related-art configuration where the size of a movable contact is limited by bosses disposed on the outer side of the movable contact, the present embodiment makes it possible to increase the size of the movable contact 3 that is placeable on the board 2. Thus, compared with the related-art configuration, the present embodiment makes it possible to increase the life of the switch 100 even when the size of the switch 100 is reduced. That is, the present embodiment can provide a small, long-life switch.

The switch 100 of the present embodiment can be used for various purposes where a small, long-life switch is required. For example, the switch 100 may be used to switch gears provided in a brake unit of an automobile.

In the present embodiment, the terminals 71A and 71B of the wire harness 7 may be configured to be removable from the switch 100 or may be fixed to the output terminals 24A and 24B by, for example, soldering. Also, the output terminals 24A and 24B of the switch 100 may be configured to protrude from the housing 1 so as to be connectable with an external apparatus. In this case, the wire harness 7 may be omitted.

A switch according to an embodiment of the present invention is described above. However, the present invention is not limited to the specifically disclosed embodiment, and variations and modifications may be made without departing from the scope of the present invention.

What is claimed is:

1. A switch, comprising:

a housing including a bottom surface and a protrusion formed on the bottom surface;

a board that is placed on the bottom surface of the housing and includes a fixed contact, the board and the protrusion being fitted together;

a movable contact that is disposed to cover at least portions of the fixed contact and the protrusion and configured to be inverted; and an operation part that presses the movable contact toward the fixed contact.

2. The switch as claimed in claim 1, wherein a height of the protrusion is lower than a height of the board.

3. The switch as claimed in claim 1, wherein the movable contact is a metal disc spring.

4. The switch as claimed in claim 1, wherein the board includes an opening; and the protrusion is fitted into the opening.

5. The switch as claimed in claim 4, wherein the protrusion is beaten out in the opening.

6. The switch as claimed in claim 1, wherein the movable contact includes legs that contact the fixed contact.

7. The switch as claimed in claim 6, wherein the protrusion is disposed between two of the legs.

* * * * *